United States Patent [19]

Milne

[11] 4,169,909

[45] Oct. 2, 1979

[54] ARTIFICIAL AND NATURAL STRUCTURES IMPREGNATED BY USING A FLEXIBLE, FLUID IMPERMEABLE COVERING

[75] Inventor: James Milne, Wigton, England

[73] Assignee: Balfour Beatty Limited, Surrey, England

[21] Appl. No.: 845,036

[22] Filed: Oct. 25, 1977

[51] Int. Cl.[2] ..... E02D 37/00

[52] U.S. Cl. ..... 427/294; 427/136; 52/743; 118/50

[58] Field of Search ..... 427/294, 136, 138, 295–298; 52/743; 118/410, 411, 50

[56] References Cited

U.S. PATENT DOCUMENTS 4,060,953 12/1977 Milne ..... 427/294

FOREIGN PATENT DOCUMENTS 1399510 of 0000 United Kingdom ..... 52/743

1480718 7/1977 United Kingdom ..... 52/743

*Primary Examiner*—Sam Silverberg

*Attorney, Agent, or Firm*—Buell, Blenko & Ziesenheim

[57] ABSTRACT

Voids in at least a part of an artificial or natural structure adjacent an exposed surface of the structure are filled with hardenable material to strengthen the structure by closely fitting over the exposed surface a flexible fluid-impermeable covering having adjacent its boundary edges an endless hollow wall that surrounds and opens towards said covered surface and sealing boundary edges of the covering to the structure to form a substantially fluid-tight enclosure incorporating the hollow walls. Air and any other fluid is evacuated from the hollow wall and from voids adjacent said covered surface and hardenable material in a liquid or semi-liquid state is allowed to enter into the evacuated voids until the hardenable material appears at openings of voids in said covered surface. The hardenable material is then allowed to set.

11 Claims, 3 Drawing Figures

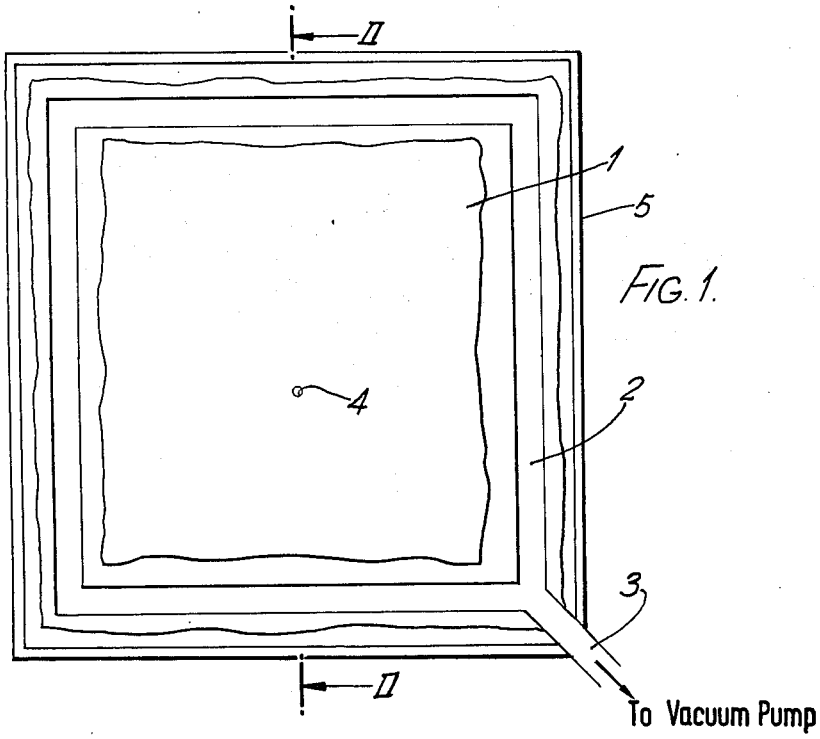
FIG. 1.
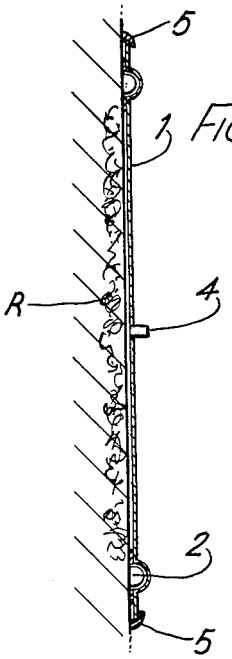
FIG. 2.
FIG. 3.
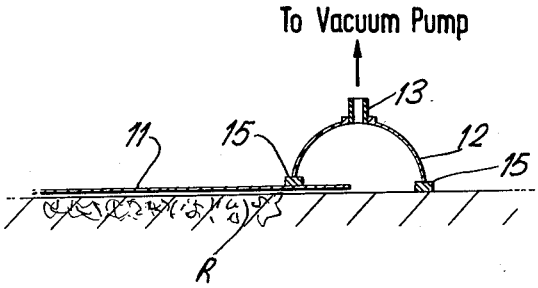

ARTIFICIAL AND NATURAL STRUCTURES IMPREGNATED BY USING A FLEXIBLE, FLUID IMPERMEABLE COVERING

This invention relates to artificial and natural structures built up of or comprising a plurality of separately formed bodies of manufactured or natural material or consisting of a single body of concrete or of rock, granite or other material in its natural state. Structures fabricated from or comprising a plurality of separately formed bodies include the walls of buildings, the abutments and piers of bridges, chimneys, brick-lined tunnels, ducts, drains and sewers, retaining walls, foundations, monuments, sculptures, archaeological remains, and other structures built up of or comprising bricks, rocks, stones, granite, timber or other building materials with or without interposed mortar or other hardenable material. Single bodies of concrete or other materials include roads, airfield runways, foundations of heavy machinery, statues and sculptures. All such artificial and natural structures will, for convenience, hereinafter be referred to as "artificial or natural structures of the kind specified."

Crumbling and similar deterioration of the material or materials of artificial or natural structures of the kind specified can be regarded as the propagation of cracks or other voids in the material that results in a complexity of interconnected fissures. The presence of cracks or other voids in an artificial or natural structure not only lowers its strength but jeopardises the structure further should these cracks or other voids propagate. Cracks and other voids in a structure act as sources of stress and can cause high stress concentrations. Moreover, if the cracks or other voids open into a surface of the structure that is exposed to the weather or if the or each material of the structure is itself of a porous nature, deterioration of the structure may arise from weathering. Thus, unless a structure having cracks, pores or other voids in it is repaired and/or strengthened, and/or unless at least part of a structure adjacent the or each exposed surface is rendered substantially non-porous, it may only be a question of time before the structure collapses, crumbles or otherwise fails.

The present invention is concerned with a method of introducing a hardenable material in a liquid or semi-liquid state into cracks or other voids in at least a part of an artificial or natural structure of the kind specified adjacent an exposed surface of the structure.

According to the present invention, the method comprises closely fitting over the exposed surface a flexible fluid-impermeable covering having adjacent its boundary edges an endless hollow wall that surrounds and opens towards said covered surface; directly or indirectly sealing boundary edges of the covering to the structure to form a substantially fluid-tight enclosure incorporating the hollow wall; evacuating air and any other fluid from the hollow wall and from cracks and other voids adjacent said covered surface; allowing hardenable material in a liquid or semi-liquid state to enter into the evacuated cracks or other voids until the hardenable material appears at the openings of cracks and voids in said covered surface; and permitting or causing the hardenable material to set.

Since, during introduction of hardenable material into the evacuated cracks or other voids adjacent the surface, the substantially fluid-tight enclosure is completely bounded by an evacuated hollow wall, any air or other fluid leaking through cracks and voids in the structure that extend under the covering from beyond its boundary edges will enter the evacuated hollow wall from where such air and other fluid will be evacuated. As a result, the risk that hardenable material introduced into the cracks and other voids adjacent the covered surface will be contaminated by bubbles of air or other fluid leaking from cracks and other voids outside the boundary edges of the flexible fluid-impermeable covering is substantially reduced.

The endless hollow wall may be an integral part of the flexible fluid-impermeable covering but, preferably, the hollow wall is formed by applying over the boundary edges of the covering, or under the covering near, but spaced from, its boundary edges, a separately formed endless preformed member of substantially channel-shaped cross-section. Where the endless preformed member is applied over the boundary edges of the covering it will be sealed to the covering and to the structure; where the endless preformed member is applied under the covering, the extreme boundary edges of the covering may be sealed to the structure by a coating of hardenable material or by adhesive tape.

Evacuation of the closely fitting, flexible fluid-impermeable covering and of the endless hollow wall is preferably effected by at least one vacuum pump and/or at least one air compressor and associated venturi suction ejector. Preferably the or each vacuum pump or air compressor and associated venturi suction ejector is connected to an outlet in the hollow wall and at least one source of hardenable material in a liquid or semi-liquid state is connected to an inlet or inlets in the covering.

The invention also includes apparatus for use in the method as hereinbefore described, which apparatus comprises a flexible sheet of fluid-impermeable material having adjacent its boundary edges an endless wall of substantially channel-shaped cross-section; at least one port in the endless wall for extraction of air and other fluid and at least one port in the part of the sheet bounded by the endless wall for injection of hardenable material in a liquid or semi-liquid state.

The endless wall may be an integral part of the sheet but preferably it comprises a separately formed endless preformed member of channel-shaped cross-section made of fluid-impermeable material. The endless preformed member may be built up of at least two preformed elongate members of channel-shaped cross-section connected end-to-end. Where the endless preformed member is to be applied over the boundary edges of the sheet it will carry, at the longitudinal edges of its side walls, means that will make a substantially fluid-tight seal with a surface to which the member is applied when the hollow wall is evacuated. Such means preferably comprises a strip of rubber or other compressible material.

The present invention is especially, but not exclusively, suitable for use in repairing or restoring a damaged area of the surface of a road or airfield runway and in this case the apparatus may be conveniently mounted on a chassis or other carriage, which may or may not be self-propelled, so that the apparatus can be readily conveyed from one site to another. The invention is also suitable for use in repairing or restoring a damaged area of a face of a building.

The invention is further illustrated by a description, by way of example, of two methods of repairing a damaged area of the surface of a road, with reference to the accompanying drawings, in which;

FIG. 1 is a plan view of the apparatus employed in the first method;

FIG. 2 is a sectional view of the apparatus taken on the line II—II in FIG. 1, and FIG. 3 is a fragmental cross-sectional view of apparatus employed in the second method.

Referring to FIGS. 1 and 2, cracks and other voids in a part of the surface of a road R, are filled with hardenable material which, on setting, restores the road to its original state by applying over the area of the road to be restored a sheet 1 of polyethylene. Positioned under a part of the sheet 1 at a position near to, but spaced from, the boundary edges of the sheet is an endless hollow wall 2 built up of a number of preformed elongate members of channel-shaped cross-section connected end-to-end which are arranged with the longitudinal edges of their side walls bearing against the surface of the road R and which positively space said part of the sheet from the road surface. An outlet 3 in the hollow wall 2 is connected to a vacuum pump (not shown) and an inlet 4 in the sheet 1 is connected to a source of hardenable material. The extreme edges of the sheet 1 are sealed to the road surface by a coating 5 of hardenable material.

In operation, air and other fluid is evacuated from cracks and other voids adjacent the road surface covered by the sheet 1 and from the hollow wall 2 and, when the air and other fluid has been removed, hardenable material in a liquid state is introduced into the evacuated cracks and other voids through the inlet 4. Any air or other fluid that may leak through cracks and other voids in the road R that extend under the sheet 1 from beyond its boundary edges will enter the hollow wall 2 and be extracted by the vacuum pump. When the cracks and other voids are filled with hardenable material, usually indicated by flow of hardenable material from the cracks and other voids opening into that part of the road surface under the hollow wall 2, the vacuum pump is switched off, the source of hardenable material is disengaged and the hardenable material in the cracks and other voids is permitted to set. The sheet 1 and the hollow wall 2 are then removed.

In the second method using the apparatus shown in FIG. 3, the boundary edges of a sheet 11 of polyethylene, that has been laid over that part of the surface of a road R to be repaired, are arranged under an endless hollow wall 12 built up of a number of preformed elongate members of semi-circular cross-section made of polyethylene. The longitudinal side walls of these members carry strips 15 of rubber. An outlet 13 in the hollow wall 12 is connected to a vacuum pump (not shown); an inlet (not shown) in the sheet 11 is connected to a source of hardenable material. In this case, when air and other fluid is evacuated from cracks and other voids adjacent the road surface under the sheet 11 and from the hollow wall 12, the rubber strips 15 effect substantially fluid-tight seals with the road surface. The further steps in this method of repairing a road surface are the same as the corresponding steps in the method described with reference to FIGS. 1 and 2.

What I claim as my invention is:

1. A method of strengthening artificial and natural structures having voids in at least a part of the structure adjacent an exposed surface of the structure, which method comprises closely fitting over the exposed surface a flexible fluid-impermeable covering having adjacent its boundary edges an endless hollow wall that surrounds and opens towards said covered surface; sealing boundary edges of the covering to the structure to form a substantially fluid-tight enclosure incorporating the hollow wall; evacuating air and any other fluid from the hollow wall and from voids adjacent said covered surface; allowing hardenable material in a liquid or semi-liquid state to enter into the evacuated voids until the hardenable material appears at openings of voids in said covered surface; and allowing the hardenable material to set.

2. A method of strengthening artificial and natural structures having voids in at least a part of the structure adjacent an exposed surface of the structure, which method comprises closely fitting over the exposed surface a flexible fluid-impermeable covering and applying over the boundary edges of the covering a separately formed preformed endless member of substantially channel-shaped cross-section to form an endless hollow wall which surrounds and opens towards said covered surface; sealing the hollow wall to the covering and to the structure to form a substantially fluid-tight enclosure incorporating the hollow wall; evacuating air and any other fluid from the hollow wall and from voids adjacent said covered surface; allowing hardenable material in a liquid or semi-liquid state to enter into the evacuated voids until the hardenable material appears at openings of voids in said covered surface; and allowing the hardenable material to set.

3. A method of strengthening artificial and natural structures having voids in at least a part of the structure adjacent an exposed surface of the structure, which method comprises closely fitting over the exposed surface a flexible fluid-impermeable covering and positively spacing a part of the covering near, but spaced from, its boundary edges from the surface to be treated by introducing under the covering a separately formed preformed endless member of substantially channel-shaped cross-section to form an endless hollow wall which surrounds and opens towards said covered surface; sealing boundary edges of the covering to the structure to form a substantially fluid-tight enclosure incorporating the hollow wall; evacuating air and any other fluid from the hollow wall and from voids adjacent said covered surface; allowing hardenable material in a liquid or semi-liquid state to enter into the evacuated voids until the hardenable material appears at openings of voids in said covered surface; and allowing the hardenable material to set.

4. A method as claimed in claim 1, wherein the endless hollow wall is an integral part of the flexible fluid-impermeable covering.

5. A method as claimed in claim 3, wherein the extremities of the boundary edges of the flexible fluid-impermeable covering are sealed to the structure by a coating of hardenable material.

6. A method as claimed in claim 1, wherein air and other fluid is evacuated from said voids and from the endless hollow wall through an outlet in the hollow wall and hardenable material is introduced into said evacuated voids through an inlet in the fluid-impermeable covering.

7. Apparatus for use in strengthening artificial and natural structures having voids in at least a part of the structure adjacent an exposed surface of the structure, which apparatus comprises a flexible sheet of fluid-impermeable material having adjacent its boundary edges an endless wall of substantially channel shaped cross-section; at least one port in the endless wall for extraction of air and other fluid and at least one port in the part of the sheet bounded by the endless wall for injection of hardenable material in a liquid or semi-liquid state.

8. Apparatus as claimed in claim 7, wherein the endless wall comprises an endless preformed member of fluid-impermeable material which is separately formed with respect to the sheet.

9. Apparatus as claimed in claim 7, wherein the longitudinal edges of the endless wall carry means that will make a substantially fluid-tight seal with a surface to which the apparatus is applied when the wall is evacuated.

10. Apparatus as claimed in claim 9, wherein said sealing means is a strip of compressible material.

11. Apparatus as claimed in claim 7, which is mounted on a movable carriage.

* * * * *